US006450159B2

(12) United States Patent
Ohkuma

(10) Patent No.: US 6,450,159 B2
(45) Date of Patent: Sep. 17, 2002

(54) FUEL VAPOR TREATMENT APPARATUS IN INTERNAL COMBUSTION ENGINE AND METHOD THEREOF

(75) Inventor: Shigeo Ohkuma, Atsugi (JP)

(73) Assignee: Unisia Jecs Corporation, Kanagawa-Ken (JP)

( * ) Notice: Subject to any disclaimer, the term of this patent is extended or adjusted under 35 U.S.C. 154(b) by 4 days.

(21) Appl. No.: 09/809,261

(22) Filed: Mar. 16, 2001

(30) Foreign Application Priority Data

Mar. 17, 2000 (JP) ..... 2000-075265

(51) Int. Cl.[7] ..... F02M 25/08; F02D 41/14

(52) U.S. Cl. ..... 123/688; 123/520; 123/690; 123/698

(58) Field of Search ..... 123/518, 519, 123/520, 688, 690, 698

(56) References Cited

U.S. PATENT DOCUMENTS 5,596,972 A * 1/1997 Sultan et al. ..... 123/520
6,176,228 B1 * 1/2001 Kerns ..... 123/698

FOREIGN PATENT DOCUMENTS

JP 7-317582 12/1995

* cited by examiner

*Primary Examiner*—Tony M. Argenbright
(74) *Attorney, Agent, or Firm*—Sughrue Mion, PLLC

(57) ABSTRACT

Based upon a purge air quantity supplied via a purge control valve to an intake system of an engine, an intake air amount into the engine, a fuel injection quantity into the engine, and an air-fuel ratio of the combustion mixture, a fuel vapor concentration is calculated as fuel vapor concentration=(intake air amount+purge air quantity air-fuel ratio×fuel injection quantity)/(the air-fuel ratio+1).

19 Claims, 2 Drawing Sheets

FUEL VAPOR TREATMENT APPARATUS IN INTERNAL COMBUSTION ENGINE AND METHOD THEREOF

BACKGROUND OF THE INVENTION

1. Field of the Invention

The present invention relates to a fuel vapor treatment apparatus in an internal combustion engine and a method thereof, especially to an apparatus and a method for estimating a concentration of fuel vapor purged from a canister.

2. Related Art of the Invention

Heretofore, a fuel vapor treatment apparatus is well known, which includes a canister for adsorbing and collecting therein fuel vapor generated in a fuel tank, a purge pipe for supplying the fuel purged from the canister to an intake air collector in an engine, and a purge control valve disposed in the purge pipe for controlling a purge air quantity (Japanese Unexamined Patent Publication No. 7-317582).

The Japanese Unexamined Patent Publication No. 7-317582 also discloses a construction that a fuel vapor inflow quantity sucked into the engine is calculated based upon a mean value of an air-fuel ratio feedback correction value and a fuel injection quantity of a fuel injection valve is corrected corresponding to the fuel vapor inflow quantity.

However, since a detection delay of the fuel vapor inflow quantity to the engine is large in the above apparatus, the correction of the fuel injection quantity is delayed and an air-fuel ratio of the combustion mixture deviates greatly from a target value, resulting in deterioration of exhaust emission.

Further, there has been a problem in that if a control gain of the purge air quantity is lowered in order to suppress an occurrence of the air-fuel ratio deviation due to the detection delay, a treatment of fuel vapor cannot be sufficiently promoted.

SUMMARY OF THE INVENTION

The present invention has been achieved in view of the foregoing problems, and has an object of providing an apparatus and a method capable of estimating a fuel vapor concentration in a good response, so that an air-fuel ratio can be maintained in the vicinity of a target air-fuel ratio and a treatment of fuel vapor can be promoted well.

In order to achieve the above object, with the present invention, the construction is such that a fuel vapor concentration in purge air is estimated based upon the purge air that is purged from a canister for adsorbing and collecting the fuel vapor, and is supplied to an intake system of an engine through a purge pipe and a purge control valve, an intake air amount of the engine, a fuel injection quantity to the engine, and an air-fuel ratio of the combustion mixture.

With this construction, by correcting a control signal output to the purge control valve based upon the concentration of the fuel vapor estimated as in the above, the purge air quantity is corrected corresponding to the concentration of the fuel vapor.

More specifically, a target purge rate is corrected based upon the estimated value of the fuel vapor concentration and a control signal in response to the corrected target purge rate is output to the purge control valve.

The fuel injection quantity to the engine may be corrected instead of correcting the purge air quantity controlled by the purge control valve.

The other objects, features of this invention will become understood from the following description with reference to the accompanying drawings.

DETAILED DESCRIPTION OF THE PREFERRED EMBODIMENT

Figure 1:
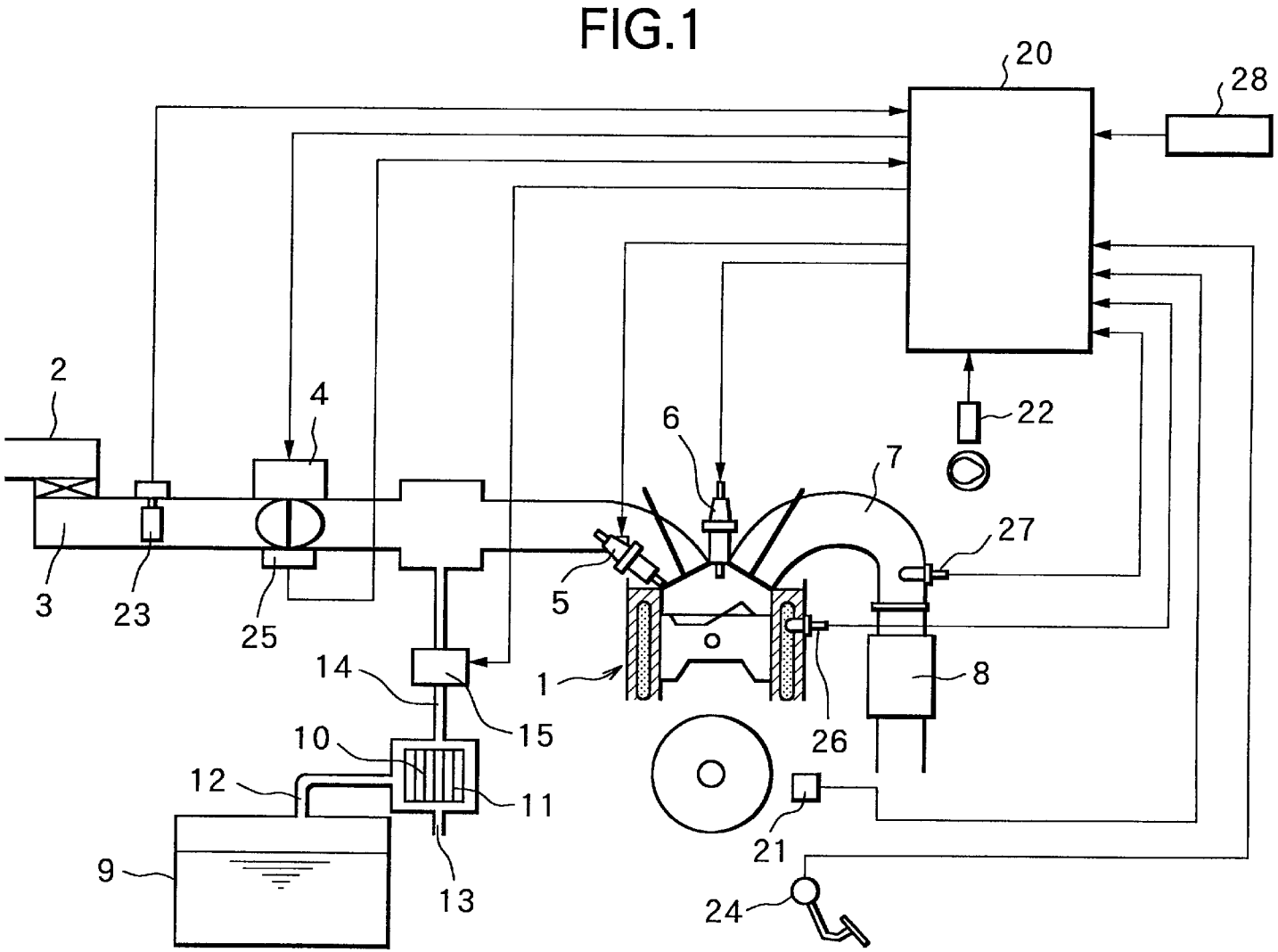
FIG. 1 is a diagram showing the system structure of an internal combustion engine in an embodiment of the present invention.

FIG. 1 is a diagram showing the system structure of an internal combustion engine for a vehicle including an apparatus for treating fuel vapor according to the present invention.

In FIG. 1, air is sucked into a combustion chamber of each cylinder in an internal combustion engine 1 mounted on a vehicle via an air cleaner 2, an intake pipe 3, and an electronically controlled throttle valve 4.

An electromagnetic fuel injection valve 5 is disposed in the combustion chamber of each cylinder to directly inject fuel thereto.

The fuel injection valve 5 is driven to open with the power supply to a solenoid thereof by an injection pulse signal output from a control unit 20, to inject fuel adjusted at a predetermined pressure.

An air-fuel mixture formed inside the combustion chamber is ignited to burn by an ignition plug 6 controlled based upon an ignition signal output from the control unit 20.

The exhaust gas from the engine 1 is discharged through an exhaust pipe 7.

A catalytic converter 8 for purifying exhaust gas is disposed in the exhaust pipe 7.

There is provided a fuel vapor treatment apparatus for, once adsorbing and collecting fuel vapor generated from a fuel tank 9 therein, supplying the fuel vapor to the engine 1 to be burnt therein.

The fuel vapor treatment apparatus comprises a canister 10, a fuel vapor introduction pipe 12, a purge pipe 14, and a purge control valve 15.

The canister 10 is a closed container filled with an adsorbent 11 such as active carbon, and is connected to a fuel vapor introduction pipe 12 extending from the fuel tank 9.

Accordingly, the fuel vapor generated in the fuel tank 9 during the engine 1 is being stopped passes through the fuel vapor introduction pipe 12 to be introduced to the canister 10 and then is adsorbed and collected by the adsorbent 11.

A new air introduction opening 13 is formed at the canister 10 and the purge pipe 14 extends from the canister 10.

In the purge pipe 14 is disposed the purge control valve 15, the opening area of which is controlled by a control signal output from the control unit 20.

In the construction mentioned above, when the purge control valve is controlled to open, an intake negative pressure of the engine acts on the canister 10. As a result, the fuel vapor that has been adsorbed to the adsorbent 11 of the canister 10 is purged by air introduced through the new air introduction opening 13.

Purge air including the purged fuel vapor is sucked through the purge pipe 14 into the intake pipe 3 on the downstream side of the throttle valve 4 and then burnt in the combustion chamber of the engine 1.

The control unit 20 incorporates a microcomputer comprising a CPU, a ROM, a RAM, an A/D converter, an input/output interface and so forth.

The control unit 20 receives input signals from various sensors and controls operations of the fuel injection valve 5, the ignition plug 6, and the purge control valve 15 by the calculation process based on these input signals.

The various sensors includes a crank angle sensor 21 for detecting a crank angle of the engine 1 and a cam sensor 22 for outputting a cylinder discrimination signal.

The engine rotation speed Ne is calculated based upon a detection signal output from the crank angle sensor 21.

Besides, there are provided an air flow meter 23 for detecing an intake air amount Qa of the engine 1 at the upstream of the throttle valve 4 in the intake pipe 3 and an accelerator sensor 24 for detecting a depression quantity of an accelerator pedal APS.

Further, there are provided a throttle sensor 25 for detecting an opening degree TVO of the throttle valve 4, a water temperature sensor 26 for detecting a cooling water temperature Tw of the engine 1, an air-fuel ratio sensor 27 for detecting in wide-range an air-fuel ratio based upon an oxygen concentration in the exhaust, and a vehicle speed sensor 28 for detecting a vehicle speed VSP.

In order to coincide an air-fuel ratio to be detected by the air-fuel ratio sensor 27 with a target air-fuel ratio, an air-fuel ratio feedback control for feedback controlling a fuel injection quantity is performed under an operating condition determined in advance.

Purging of the fuel vapor from the canister 10 is executed on a condition that the air-fuel ratio feedback control is being performed.

Figure 2:
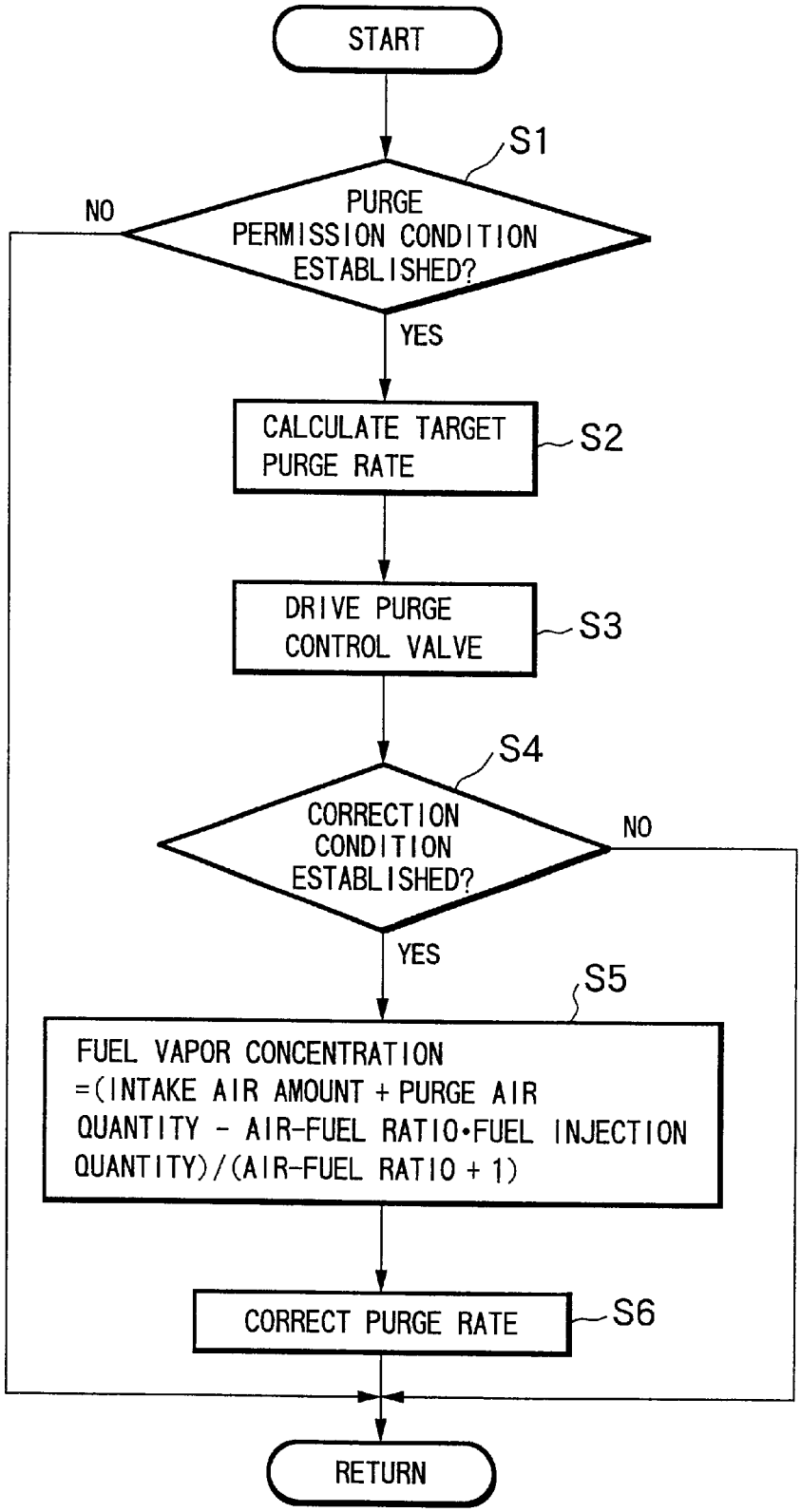
FIG. 2 is a flowchart showing a purge control in the embodiment of the present invention.

A purge control to be executed by the control unit 20 will be explained according to a flowchart in FIG. 2.

At Step S1, it is judged whether or not a purge execution permission condition is established.

Specifically, when the air-fuel ratio feedback control is being performed, it is judged that the purge execution permission condition is established, and the routine goes to Step S2.

At Step S2, a target purge rate is calculated based on the operating condition of the engine 1.

At Step S3, a control signal in response to the target purge rate is output to the purge control valve 15.

At Step S4, it is judged whether or not a correction permission condition of the purge rate is established.

The correction permission condition includes a condition where the air-fuel ratio sensor 27 is in a normal and active state, a condition where the air flow meter 23 is in a normal state, and a condition where a time determined in advance has elapsed after the target purge rate has changed.

When it is judged at Step S4 that the correction permission condition of the purge rate is established, the routine goes to Step S5 wherein a fuel vapor concentration is calculated.

The calculation of the fuel vapor concentration at Step S5 is simply shown by the following equation.

$$\text{fuel vapor concentration}=(\text{intake air amount}+\text{purge air quantity air-fuel ratio}\times\text{fuel injection quantity})/(\text{air-fuel ratio}+1)$$

In the above equation, the intake air amount is a detection value of the air flow meter 23, the purge air quantity is a value estimated based on the intake negative pressure of the engine 1 and a control signal of the purge control valve 15, the air-fuel ratio is a detection value of the air-fuel ratio sensor 27, and the fuel injection quantity is a injection quantity of the fuel injection valve 5.

The intake negative pressure of the engine 1 may be detected by a negative pressure sensor, and also may be estimated based on the engine rotation speed and the throttle opening.

When the purge air quantity Pe is composed of an air quantity Qp and a fuel gas quantity Fe, the air quantity Op is obtained by subtracting the fuel gas quantity Fe from the purge air quantity Pe estimated based on the intake negative pressure and the control signal of the purge control valve 15 (Qp=Pe−Fe).

The sum of the air quantity Qp and an air quantity Om detected by the air flow meter 23 is sucked into the engine 1.

On the other hand, a fuel quantity to be supplied to the engine 1 is the sum of a fuel injection quantity Ti in the fuel injection valve 5 and the fuel gas quantity Fe. If an air-fuel ratio at that time is A/F, $$A/F=\{(Pe-Fe)+Qm\}/(Fe+Ti).$$

If the above equation is transformed to the equation for obtaining the fuel gas quantity Fe, $$Fe=(Pe+Qm-A/F\cdot Ti)/(A/F+1),$$

thereby leading to the equation for obtaining the fuel vapor concentration.

The purge air quantity Pe and the air quantity Qm are determined as a flow quantity (liter/min) while the fuel injection quantity Ti is determined as a fuel quantity per one cycle of each cylinder.

Therefore, since the fuel injection quantity Ti is required to be converted to a fuel quantity, it is converted to the fuel quantity by multiplying the fuel injection quantity Ti by a conversion coefficient K1 set based upon the engine rotation speed.

Further, in the construction where the purge air quantity is estimated by the intake negative pressure and the control signal of the purge control valve 15, a value equivalent to the purge air quantity can be calculated by multiplying a control signal DUTY by a coefficient K2 corresponding to the intake negative pressure.

Accordingly, when the coefficients K1 and K2 are used, $$\text{fuel vapor concentration}=(Qm+K2\cdot\text{DUTY}-A/F\cdot Ti\cdot K1)/(A/F+1).$$

As described above, since the fuel vapor concentration is estimated based upon the correlation between the mixture formed by including air and fuel additionally supplied by purging and an air-fuel ratio of the combustion mixture, the fuel vapor concentration can be estimated with high accuracy.

At Step S6, the purge rate is corrected to be made smaller, as the fuel vapor concentration calculated at Step S5 becomes higher than a reference fuel vapor concentration, and the purge rate is corrected to be made greater, as the fuel vapor concentration calculated at Step S5 becomes lower than the reference fuel vapor concentration.

When the purge rate is corrected as described above, the fuel vapor treatment can be promoted while suppressing a fluctuation of the air-fuel ratio due to the purge.

Together with or instead of the correction of the purge rate, the fuel injection quantity may be corrected in accordance with the fuel vapor concentration.

Moreover, in the construction where purging is performed during the air-fuel ratio feedback control, a change in air-fuel ratio can be estimated based on the feedback correction value.

However, in such a construction, a detection response characteristic is not good since the air-fuel ratio change due to the purge is detected after the air-fuel ratio feedback control is converged.

On the contrary, in the construction to have the air-fuel ratio sensor 27 as described above, the air-fuel ratio change due to the purge can be detected without a large delay by the air-fuel ratio sensor 27. Therefore, even if a relatively great value is set as an initial purge rate, the fuel vapor treatment can be promoted since the deterioration of the emission can be sufficiently suppressed.

The entire contents of Japanese Patent Application No. 2000-075265, filed Mar. 17, 2000, are incorporated herein by reference.

What is claimed is:

1. A fuel vapor treatment apparatus in an internal combustion engine comprising:

a fuel tank;

a canister for adsorbing and collecting fuel vapor generated in said tank;

a purge pipe for supplying to an intake system of said engine the fuel vapor that has been purged from said canister by using an intake negative pressure of said engine;

a purge control valve disposed in said purge pipe, for controlling a purge air quantity supplied to said intake system of said engine;

a control signal output unit for outputting a control signal to said purge control valve;

a purge air quantity estimation unit for estimating said purge air quantity;

an intake air amount detection unit for detecting an intake air amount into said engine;

a fuel injection quantity calculation unit for calculating a fuel injection quantity to said engine;

an air-fuel ratio detection unit for detecting an air-fuel ratio of the combustion mixture of said engine; and a concentration estimation unit for estimating a fuel vapor concentration in said purge air based upon said purge air quantity, said intake air amount, said fuel injection quantity and said air-fuel ratio, to output a signal indicative of said estimated concentration.

2. A fuel vapor treatment apparatus in an internal combustion engine according to claim 1, further comprising;

a purge air quantity correction unit for correcting said control signal output from said control signal output unit based upon said signal output from said concentration estimation unit.

3. A fuel vapor treatment apparatus in an internal combustion engine according to claim 1, further comprising:

an operating condition detection unit for detecting an operating condition of said engine;

a target purge rate calculation unit for calculating a target purge rate in accordance with said operating condition of said engine; and a target purge rate correction unit for correcting said target purge rate based upon said signal output from said concentration estimation unit, wherein said control signal output unit outputs to said purge control valve a control signal corresponding to said corrected target purge rate.

4. A fuel vapor treatment apparatus in an internal combustion engine according to claim 1, further comprising;

a fuel injection quantity correction unit for correcting said fuel injection quantity calculated at said fuel injection quantity calculation unit based upon said signal output from said concentration estimation unit.

5. A fuel vapor treatment apparatus in an internal combustion engine according to claim 1, further comprising;

an intake negative pressure detection unit for detecting an intake negative pressure of said engine, wherein said purge air estimation unit estimates said purge air quantity based upon said control signal of said purge control valve and said intake negative pressure.

6. A fuel vapor treatment apparatus in an internal combustion engine according to claim 1, wherein said concentration estimation unit calculates said fuel vapor concentration as $$\text{fuel vapor concentration}=(\text{intake air amount}+\text{purge air quantity}-\text{air-fuel ratio}\times\text{fuel injection quantity})/(\text{air-fuel ratio}+1).$$

7. A fuel vapor treatment apparatus in an internal combustion engine according to claim 1, further comprising;

a permission condition judgment unit for judging whether or not said intake air amount detection unit and said air-fuel ratio detection unit are normal, respectively; and an estimation process stop unit for stopping the estimation of said fuel vapor concentration in said concentration estimation unit when it is judged by said permission condition judgment unit that at least one of said intake air amount detection unit and said air-fuel ratio detection unit is abnormal.

8. A fuel vapor treatment apparatus in an internal combustion engine according to claim 1, wherein said air-fuel ratio detection unit is an air-fuel ratio sensor for detecting said air-fuel ratio of said combustion mixture based upon an oxygen concentration in the exhaust, said fuel vapor treatment apparatus further comprising:

a permission condition judgment unit for judging whether or not said air-fuel ratio sensor is in an active state; and an estimation process stop unit for stopping the estimation of said fuel vapor concentration in said concentration estimation unit when it is judged by said permission condition judgment unit that said air-fuel ratio sensor is in a non-active state.

9. A fuel vapor treatment apparatus in an internal combustion engine according to claim 1, further comprising;

an operating condition detection unit for detecting an operating condition of said engine;

a target purge rate calculation unit for calculating a target purge rate in accordance with said operating condition of said engine, wherein said control signal output unit outputs to said purge control valve said control signal corresponding to said target purge rate, and said control signal output unit comprises:

a time measurement unit measuring an elapsed time from a change in said target purge rate calculated by said target purge rate calculation unit; and an estimation process stop unit for stopping the estimation of said fuel vapor concentration in said concentration estimation unit when said elapsed time is less than a predetermined time.

10. A fuel vapor treatment apparatus in an internal combustion engine comprising;

a fuel tank;

a canister for adsorbing and collecting fuel vapor generated in said tank;

a purge pipe for supplying to an intake system of said engine the fuel vapor that has been purged from said canister by using an intake negative pressure of said engine;

a purge control valve disposed in said purge pipe, for controlling a purge air quantity supplied to said intake system of said engine;

a control signal output means for outputting a control signal to said purge control valve;

a purge air quantity estimation means for estimating said purge air quantity;

an intake air amount detection means for detecting an intake air amount into said engine;

a fuel injection quantity calculation means for calculating a fuel injection quantity to said engine;

an air-fuel ratio detection means for detecting an air-fuel ratio of the combustion mixture of said engine; and a concentration estimation means for estimating a fuel vapor concentration in said purge air based upon said purge air quantity, said intake air amount, said fuel injection quantity and said air-fuel ratio, to output a signal indicative of said estimated concentration.

11. A fuel vapor treatment method in an internal combustion engine comprising the steps of:

estimating a quantity of purge air purged from a canister for adsorbing and collecting fuel vapor to be supplied to an intake system of said engine via a purge pipe and a purge control valve;

detecting an intake air amount into said engine;

calculating a fuel injection quantity to said engine;

detecting an air-fuel ratio of the combustion mixture of said engine; and estimating a fuel vapor concentration in said purge air based upon said purge air quantity, said intake air amount, said fuel injection quantity and said air-fuel ratio, to output a signal indicative of said estimated concentration.

12. A fuel vapor treatment method in an internal combustion engine according to claim 11, further comprising the step of;

correcting said control signal output to said purge control valve based upon said signal indicative of said fuel vapor concentration.

13. A fuel vapor treatment method in an internal combustion engine according to claim 11, further comprising the steps of:

detecting an operating condition of said engine;

calculating a target purge rate in accordance with said operating condition of said engine;

correcting said target purge rate based upon said signal indicative of said fuel vapor concentration; and outputting to said purge control valve a control signal corresponding to said corrected target purge rate.

14. A fuel vapor treatment method in an internal combustion engine according to claim 11, further comprising the step of;

correcting said fuel injection quantity into said engine based upon said signal indicative of said fuel vapor concentration.

15. A fuel vapor treatment method in an internal combustion engine according to claim 11, wherein said step of estimating a quantity of purge air comprises the steps of:

detecting an intake negative pressure of said engine; and estimating said purge air quantity based upon said control signal of said purge control valve and said intake negative pressure.

16. A fuel vapor treatment method in an internal combustion engine according to claim 11, wherein said step of estimating a fuel vapor concentration calculates said fuel vapor concentration as $$\text{fuel vapor concentration}=(\text{intake air amount}+\text{purge air quantity}-\text{air-fuel ratio}\times\text{fuel injection quantity})/(\text{air-fuel ratio}+1).$$

17. A fuel vapor treatment method in an internal combustion engine according to claim 11, further comprising the steps of;

judging whether or not said step of detecting an intake air amount and said step of detecting an air-fuel ratio are normal, respectively; and stopping the estimation of said fuel vapor concentration in said step of estimating a fuel vapor concentration when at least one of said step of detecting an intake air amount and said step of detecting an air-fuel ratio is abnormal.

18. A fuel vapor treatment method in an internal combustion engine according to claim 11, wherein said step of detecting an air-fuel ratio detects said air-fuel ratio of said combustion mixture based upon a detection signal from an air-fuel ratio sensor sensitive to an oxygen concentration in the exhaust, said fuel vapor treatment method further comprising the steps of:

judging whether or not said air-fuel ratio sensor is in an active state; and stopping the estimation of said fuel vapor concentration in said step of estimating a fuel vapor concentration when it is judged that said air-fuel ratio sensor is in a non-active state.

19. A fuel vapor treatment method in an internal combustion engine according to claim 11, further comprising the steps of:

detecting an operating condition of said engine;

calculating a target purge rate in accordance with said operating condition of said engine, measuring an elapsed time from a change in said target purge rate; and stopping the estimation of said fuel vapor concentration in said step of estimating a fuel vapor concentration when said elapsed time is less than a predetermined time.

* * * * *